US008801480B2

(12) United States Patent
Tsutsui et al.

(10) Patent No.: US 8,801,480 B2
(45) Date of Patent: Aug. 12, 2014

(54) TRIM/TILT APPARATUS FOR MARINE VESSEL PROPULSION MACHINE

(75) Inventors: Hayato Tsutsui, Haga-gun (JP); Kazuhiko Sadakata, Haga-gun (JP); Shinya Horie, Haga-gun (JP); Nobuaki Tanaka, Haga-gun (JP)

(73) Assignee: Showa Corporation (JP)

( * ) Notice: Subject to any disclaimer, the term of this patent is extended or adjusted under 35 U.S.C. 154(b) by 166 days.

(21) Appl. No.: 13/243,320

(22) Filed: Sep. 23, 2011

(65) Prior Publication Data

US 2012/0220177 A1 Aug. 30, 2012

(30) Foreign Application Priority Data

Feb. 25, 2011 (JP) ..... 2011-040868

(51) Int. Cl.
*B63H 20/10* (2006.01)

(52) U.S. Cl.
USPC ..... 440/61 J

(58) Field of Classification Search
CPC ..... B63H 20/10
USPC ..... 440/61 R, 61 S, 61 A, 61 C, 61 T, 61 D, 440/61 E, 61 F, 61 G, 61 H, 61 J
See application file for complete search history.

(56) References Cited

U.S. PATENT DOCUMENTS 4,050,359 A * 9/1977 Mayer ..... 92/113
4,687,449 A * 8/1987 Fenrich ..... 440/61 R
6,276,976 B1 * 8/2001 Saito ..... 440/61 R

FOREIGN PATENT DOCUMENTS

JP 2000-233797 8/2000

* cited by examiner

*Primary Examiner* — Lars A Olson
*Assistant Examiner* — Andrew Polay
(74) *Attorney, Agent, or Firm* — Keith H. Orum; Orum & Roth, LLC

(57) ABSTRACT

In a trim/tilt apparatus for a marine vessel propulsion machine, a trim piston is provided with a communication passage which communicates a second tilt chamber with a second trim chamber. The second tilt chamber between the trim piston and a tilt piston can be normally directly communicated with the second trim chamber, and the tilt piston is provided with a shock blow valve which is opened when a working fluid in a first tilt chamber reaches a set pressure, and transfers the working fluid in the first tilt chamber to the second tilt chamber.

2 Claims, 5 Drawing Sheets

TRIM/TILT APPARATUS FOR MARINE VESSEL PROPULSION MACHINE

BACKGROUND OF THE INVENTION

1. Field of the Invention

The present invention relates to a trim/tilt apparatus for a marine vessel propulsion machine for an outboard motor, an inboard outdrive engine or the like.

2. Description of the Related Art

Conventionally, in a trim/tilt apparatus for a marine vessel propulsion machine, there has been one in which a cylinder apparatus is interposed between a hull and a marine vessel propulsion machine supported to the hull so as to be tiltable, and which extends and retracts the cylinder apparatus so as to actuate the marine vessel propulsion machine to trim and tilt, by controlling so as to supply or discharge a working fluid from a working fluid supply/discharge apparatus to the cylinder apparatus.

In a trim/tilt apparatus described in Japanese Patent Application Laid-Open No. 2000-233797 (Patent Document 1), the cylinder apparatus includes a housing which is used by being connected to one of a hull and a marine vessel propulsion machine and forms a large-diameter trim chamber. A cylinder is inserted into a trim chamber of the housing so as to extend and retract and forms a small-diameter tilt chamber. A large-diameter trim piston is fixed to a cylinder end portion inside the trim chamber of the housing and divides the trim chamber into a first trim chamber on a side which accommodates the cylinder and a second trim chamber on a side which does not accommodate the cylinder. A piston rod is used by being connected to the other of the hull and the marine vessel propulsion machine, and is inserted into the tilt chamber of the cylinder so as to be extensible and retractable. A small-diameter tilt piston is fixed to a piston rod end portion inside the tilt chamber of the cylinder, and divides the tilt chamber into a first tilt chamber on a side which accommodates the piston rod and a second tilt chamber on a side which does not accommodate the piston rod.

Further, in the trim/tilt apparatus described in Patent Document 1, in order to absorb an impact force of driftwood coming into collision during logging under an arbitrary trim attitude of the marine vessel propulsion machine by a flip-up of the marine vessel propulsion machine, and to bring back the marine vessel propulsion machine to an original trim attitude capable of logging after absorbing the impact force, the tilt piston is provided with a shock blow valve and a return valve. The shock blow valve is opened at a set pressure in the case where the impact force in an extending direction of the cylinder apparatus is applied when the driftwood comes into collision with the marine vessel propulsion machine, transfers the working fluid in the first tilt chamber to a side of a free piston existing within the second tilt chamber so as to allow the piston rod to be extensible, and absorbs the impact force by flipping up the marine vessel propulsion machine from the original trim attitude. At this time, the free piston stays at its position, and only the tilt piston moves. The return valve opens in the case where the tilt piston of the piston rod is going to return to its original position (the position at which the free piston stays) due to its own weight of the marine vessel propulsion machine after absorbing the impact force by the valve opening mentioned above of the shock blow valve, brings back the working fluid between the tilt piston and the free piston to the first tilt chamber, and brings back the marine vessel propulsion machine to the original trim attitude capable of logging, in which a propeller of the marine vessel propulsion machine is submerged.

However, in the trim/tilt apparatus described in Patent Document 1, in order to cope with the collision of the driftwood against the marine vessel propulsion machine, it is necessary to provide the free piston and provide the tilt piston with a return valve, so that there is a disadvantage of a heavy weight and a high cost caused by an increase in the number of parts.

SUMMARY OF THE INVENTION

An object of the present invention is to achieve weight saving and a cost reduction by a reduction of the number of parts, in a trim/tilt apparatus which can cope with collision with driftwood.

In one embodiment of the present invention, there is provided a trim/tilt apparatus for a marine vessel propulsion machine, comprising a cylinder apparatus interposed between a hull and a marine vessel propulsion machine which is supported to the hull so as to be tiltable. The cylinder apparatus is capable of being extended and retracted so as to make the marine vessel propulsion machine carry out a trim motion and a tilt motion, by controlling to supply or discharge a working fluid from a working fluid supply/discharge apparatus to the cylinder apparatus. The cylinder apparatus comprises a housing which is used by being connected to one of the hull and the marine vessel propulsion machine and which forms a large-diameter trim chamber. A cylinder is inserted into the trim chamber of the housing so as to be extensible and retractable, and forms a small-diameter tilt chamber. A large-diameter trim piston is fixed to a cylinder end portion inside the trim chamber of the housing, and divides the trim chamber into a first trim chamber on a side which accommodates the cylinder, and a second trim chamber on a side which does not accommodate the cylinder. A piston rod is used by being connected to the other of the hull and the marine vessel propulsion machine, and is inserted into the tilt chamber of the cylinder so as to be extensible and retractable. A small-diameter tilt piston is fixed to a piston rod end portion inside the tilt chamber of the cylinder, and divides the tilt chamber into a first tilt chamber on a side which accommodates the piston rod and a second tilt chamber on a side which does not accommodate the piston rod. The trim piston is provided with a communication passage which communicates the second tilt chamber with the second trim chamber, thereby enabling the second tilt chamber between the trim piston and the tilt piston to be normally directly communicated with the second trim chamber. The tilt piston is provided with a shock blow valve which is opened so as to transfer the working fluid in the first tilt chamber to the second tilt chamber, when the working fluid in the first tilt chamber reaches a set pressure.

In one embodiment of the present invention, there is provided a trim/tilt apparatus for a marine vessel propulsion machine wherein the cylinder is inserted into the trim chamber from a cylinder guide which is provided in an open end of the housing so as to be extensible and retractable, at a time of a trim up and down operation in a trim region. The cylinder guide is threadably attached to the open end of the housing, and is provided with a seal member which comes into close contact with the trim chamber, and a seal member which comes into slidable contact with an outer surface of the cylinder.

In another embodiment of the present invention, there is provided a trim/tilt apparatus for a marine vessel propulsion machine wherein the cylinder is structured such that a portion protruding outward from the cylinder guide of the housing in a trim motion region is covered with a sub tank housing which constitutes the working fluid supply/discharge apparatus. A lower end opening portion of the sub tank housing is fitted around the cylinder guide, and a lower end flange portion of the sub tank housing is fastened in a liquid tight manner to the open end surface of the housing via a seal member. A seal member enabling the piston rod to come into slidable contact in a liquid tight manner is provided in an upper end opening portion of the sub tank housing.

In accordance with the present embodiment, the following operations and effects can be achieved.

(a) If driftwood comes into collision with the propulsion unit under logging in the arbitrary trim attitude, and the impact force in the extending direction of the cylinder apparatus is applied to the propulsion unit, the shock blow valve opens at the set pressure. Working fluid in the first tilt chamber is transferred to the second tilt chamber having no free piston, that is, the second tilt chamber between the trim piston and the tilt piston. The piston rod 61 is extended, and the propulsion unit is flipped up from the original trim attitude, and absorbs the impact force.

At this time, since the piston rod is extended abruptly by the impact, a volume increasing amount of the second tilt chamber is much larger with respect to the oil amount which is transferred to the second tilt chamber, and a vacuum portion is generated in the second tilt chamber.

Accordingly, the tilt piston of the piston rod goes into the second tilt chamber such that its own weight of the propulsion unit crushes the vacuum portion of the second tilt chamber mentioned above, after absorbing the impact force by the valve opening mentioned above of the shock blow valve, thereby coming back to the trim attitude which can log and in which the propeller of the propulsion unit is immersed.

(b) In accordance with the item (a) mentioned above, in the trim/tilt apparatus which can cope with the collision of the driftwood, the free piston is not provided, and the return valve is not provided in the tilt piston. It is possible to achieve a weight saving and a cost reduction by reducing the number of parts.

BRIEF DESCRIPTION OF THE DRAWINGS

The present invention will be more fully understood from the detailed description given below and from the accompanying drawings which should not be taken to be a limitation on the invention, but are for explanation and understanding only.

The drawings.

DESCRIPTION OF THE PREFERRED EMBODIMENTS

Figure 1:
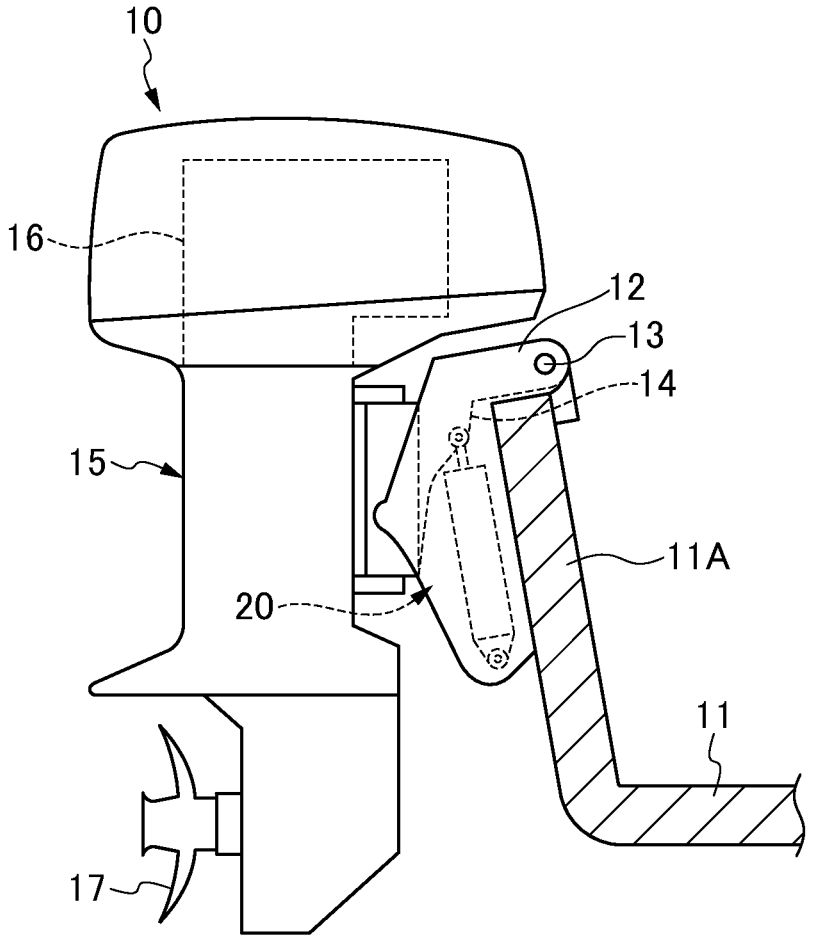
FIG. 1 is a schematic view showing a marine vessel propulsion machine.

A marine vessel propulsion machine 10 (an outboard motor, or an inboard outdrive engine) is structured, as shown in FIG. 1, such that a clamp bracket 12 is fixed to a stern plate 11A of a hull 11, and a swivel bracket 14 is pivoted to the clamp bracket 12 via a tilt shaft 13 so as to be tiltable around an approximately horizontal axis. A propulsion unit 15 is pivoted to the swivel bracket 14 via a steering shaft which is not illustrated and is approximately vertically arranged, so as to be rotatable around the steering shaft. An engine unit 16 is mounted on an upper portion of the propulsion unit 15, and a propeller 17 is provided in a lower portion of the propulsion unit 15.

In other words, the marine vessel propulsion machine 10 is structured such that the propulsion unit 15 is supported to the clamp bracket 12 fixed to the hull 11 via the tilt shaft 13 and the swivel bracket 14 so as to be tiltable. A cylinder apparatus 21 of a trim/tilt apparatus 20 is interposed between the clamp bracket 12 and the swivel bracket 14, and a working fluid is controlled to be supplied or discharged from a working fluid supply/discharge apparatus 22 to the cylinder apparatus 21, thereby extending and retracting the cylinder apparatus 21 so as to make the propulsion unit 15 tiltable in a trim region or a tilt region. In this case, the marine vessel propulsion machine 10 can obtain an optimum log attitude with respect to a change of a water surface load by maintaining the propulsion unit 15 in a comparatively slow slope state within the trim region.

(Cylinder Apparatus 21)

Figure 2:
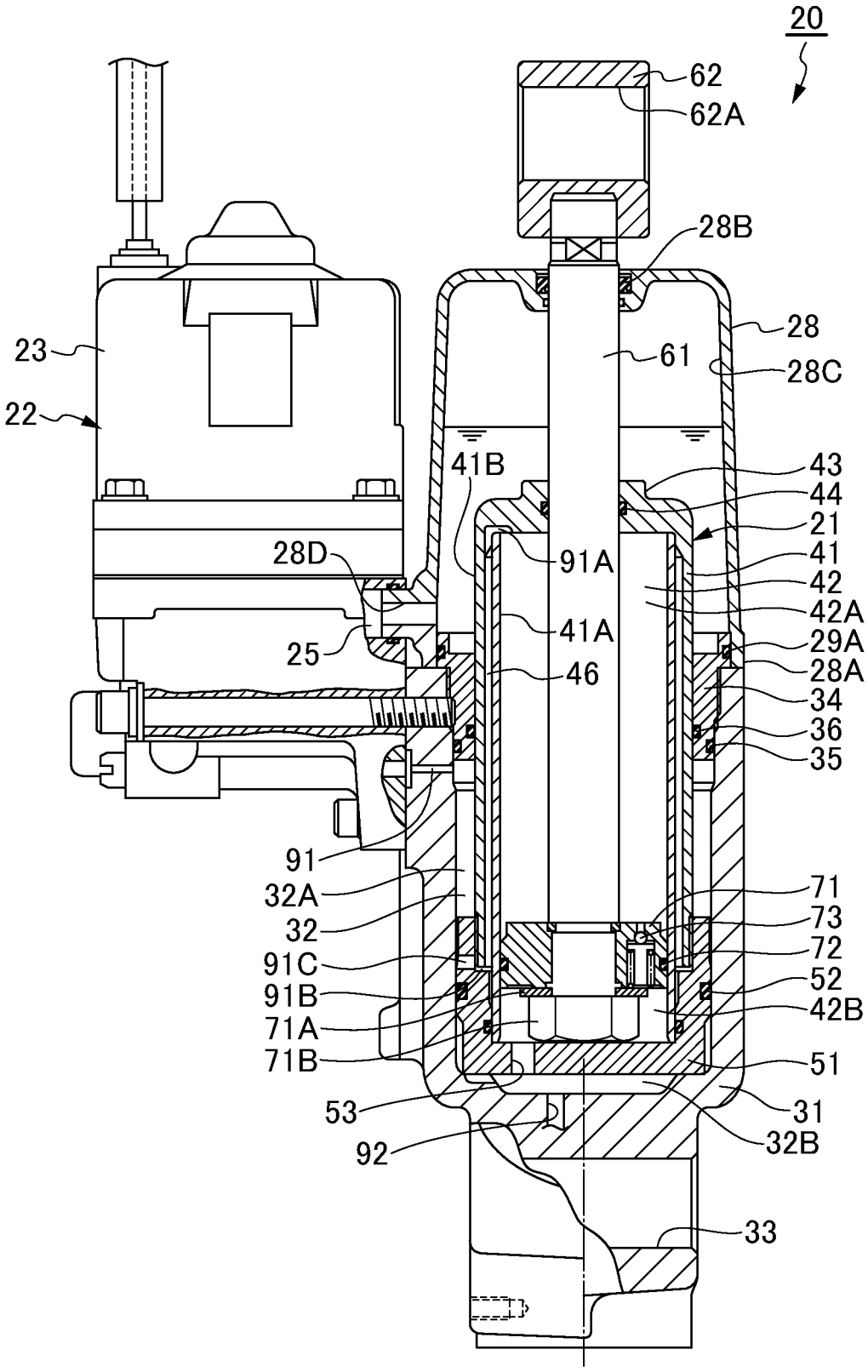
FIG. 2 is a schematic view showing a trim/tilt apparatus.

The cylinder apparatus 21 of the trim/tilt apparatus 20 has a housing 31 which is used by being connected to the clamp bracket 12, and forms a large-diameter trim chamber 32 in the housing 31, as shown in FIGS. 1 and 2. In this case, the housing 31 is manufactured by casting, for example, of an aluminum alloy, and is provided with an attaching pin installation hole 33 to the clamp bracket 12.

Further, the cylinder apparatus 21 has a cylinder 41 which is inserted into the trim chamber 32 from a cylinder guide 34 provided in an open end of the housing 31 so as to be extensible and retractable, at a time of a trim up and down operation in the trim region, and forms a small-diameter tilt chamber 42 in the cylinder 41. The cylinder guide 34 is threadably attached to the open end of the housing 31, is provided with a seal member 35 such as an O-ring which comes into close contact with the trim chamber 32, and is provided with a seal member 36 such as an O-ring which comes into slidable contact with an outer surface of the cylinder 41.

Further, the cylinder apparatus 21 has a large-diameter trim piston 51 which is threadably attached and fixed to an end portion of the cylinder 41 inside the trim chamber 32 of the housing 31. The trim piston 51 is provided with a seal member 52 such as an O-ring which comes into slidable contact with an inner surface of the trim chamber 32, and divides the trim chamber 32 into a first trim chamber 32A on a side which accommodates the cylinder 41, and a second trim chamber 32B on a side which does not accommodate the cylinder 41.

Further, the cylinder apparatus 21 has a piston rod 61 which is provided so as to be connected to the swivel bracket 14, and inserts the piston rod 61 into the tilt chamber 42 from a rod guide portion 43 which is provided in an open end of the cylinder 41 so as to be extensible and retractable at a time of a tilt up and down operation in the tilt region. The rod guide portion 43 is provided with a seal member 44 such as an O-ring which comes into slidable contact with an outer surface of the piston rod 61. The piston rod 61 is provided with an attaching pin installation hole 62A to the swivel bracket 14 in an attaching joint 62.

Further, the cylinder apparatus 21 has a small-diameter tilt piston 71 which is fixed to an end portion of the piston rod 61 inside the tilt chamber 42 of the cylinder 41 via a washer 71A by a nut 71B. The tilt piston 71 is provided with a seal member 72 such as an O-ring which comes into slidable contact with an inner surface of the cylinder 41, and divides the tilt chamber 42 into a first tilt chamber 42A on a side which accommodates the piston rod 61, and a second tilt chamber 42B on a side which does not accommodate the piston rod 61.

Accordingly, in the cylinder apparatus 21, the cylinder 41 is formed by forging an iron-based material. An outer pipe 41B and the rod guide portion 43 mentioned above are integrally formed by forging, the number of assembling steps is reduced, and a high strength is achieved. Further, the cylinder 41 is formed as a tilt cylinder assembly by pinching an inner pipe 41A between a concave portion which is provided in an inner end surface of the rod guide portion 43, and a concave portion which is provided in an inner end surface of the trim piston 51 mentioned above and threadably attached to the outer pipe 41B. Accordingly, the cylinder 41 is formed as a double tube structure consisting of the inner pipe 41A and the outer pipe 41B, and a gap between the inner pipe 41A and the outer pipe 41B is formed as a communication passage 46 which communicates the first trim chamber 32A and the first tilt chamber 42A. In other words, the first trim chamber 32A is directly connected to a first flow path 91 which is provided in the housing 31. The first tilt chamber 42A is connected to the first flow path 91 via a passage 91A which is provided in the inner pipe 41A of the cylinder 41, the communication passage 46 of the cylinder 41. A passage 91B is provided in the outer pipe 41B of the cylinder 41. A passage 91C is provided in the trim piston 51, and the first trim chamber 32A. In accordance with this, the first trim chamber 32A and the first tilt chamber 42A are communicated with a supply side of the working fluid supply/discharge apparatus 22 via the first flow path 91 in (a) a retraction stroke of a trim motion and a tilt motion, and are communicated with a discharge side of the working fluid supply/discharge apparatus 22 via the first flow path 91 in (b) an extension stroke.

Further, in the cylinder apparatus 21, the trim piston 51 has a through-hole shaped communication passage 53 which communicates the second trim chamber 32B and the second tilt chamber 42B. In other words, the second trim chamber 32B is directly connected to the second flow path 92 which is provided in the housing 31, and the second tilt chamber 42B is connected to the second flow path 92 via the communication passage 53 of the trim piston 51 and the second trim chamber 32B. In accordance with this, the second trim chamber 32B and the second tilt chamber 42B are communicated with the supply side of the working fluid supply/discharge apparatus 22 via the second flow path 92 in (a) an extension stroke of the trim motion and the tilt motion, and are communicated with the discharge side of the working fluid supply/discharge apparatus 22 via the second flow path 92 in (b) a retraction stroke.

(Working Fluid Supply/Discharge Apparatus 22)

The working fluid supply/discharge apparatus 22 consists of a reversible type motor 23, a reversible type gear pump 24, a tank 25 and a flow path 26 with selector valve, and can supply and discharge the working fluid to the first trim chamber 32A, the second trim chamber 32B, the first tilt chamber 42A and the second tilt chamber 42B of the cylinder apparatus 21, via the first flow path 91 and the second flow path 92 mentioned above.

Further, in the present embodiment, a portion in which the cylinder 41 of the cylinder apparatus 21 protrudes outward from the cylinder guide 34 of the housing 31 in the trim motion region is coated with a sub tank housing 28 constituting the working fluid supply/discharge apparatus 22. The sub tank housing 28 is made, for example, of a resin. A lower end opening portion of the sub tank housing 28 is fitted around the cylinder guide 34, and a lower end flange portion 28A of the sub tank housing 28 is fastened in a liquid tight manner to an open end surface of the housing 31 via the O-ring 29A by a bolt. Further, a seal member 28B such as an oil seal with which the piston rod 61 can come into slidable contact in a liquid tight manner is provided in an upper end opening portion of the sub tank housing 28. In accordance with this, the sub tank housing 28 is provided in a rising manner so as to interpose a fixed gap around the cylinder 41 and the piston rod 61 along a longitudinal direction of the cylinder 41 and the piston rod 61 so as to form a sub tank 28C. The sub tank 28C is communicated with the tank 25 mentioned above of the housing 31 via a communication port 28D which is provided in the sub tank housing 28.

Figure 5:
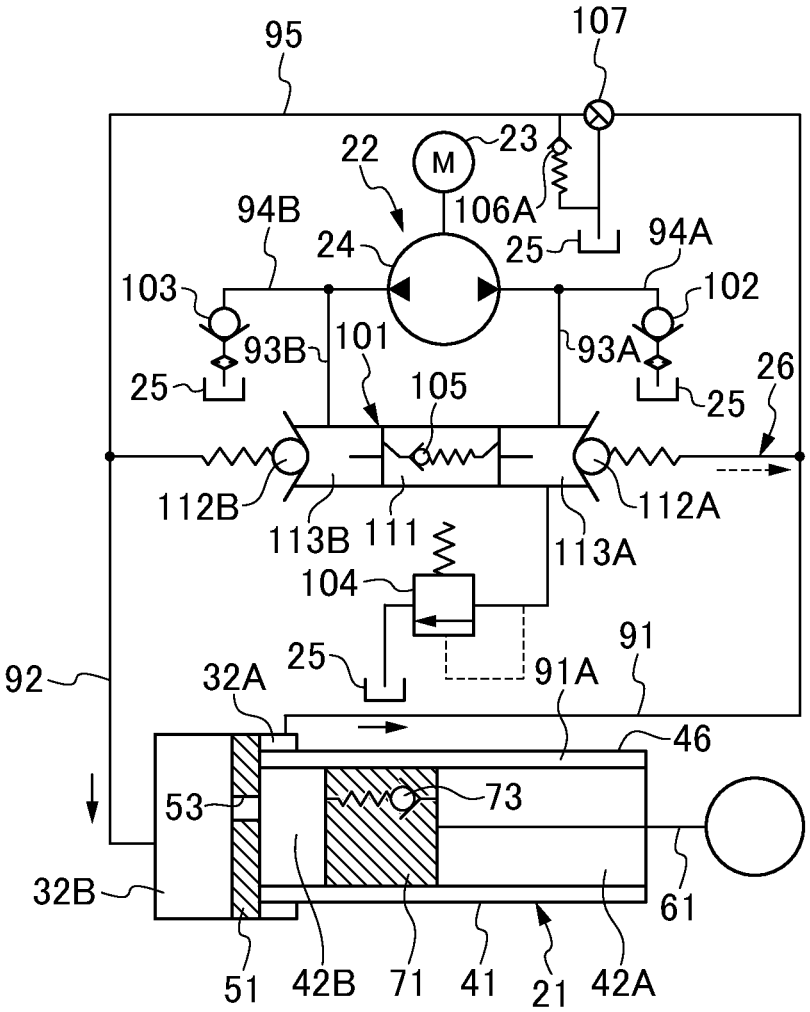
FIG. 5 is a hydraulic circuit diagram of the trim/tilt apparatus.

In this case, the working fluid supply/discharge apparatus 22 embeds the flow path 26 with selector valve which communicates the pump 24 with the first flow path 91 and the second flow path 92 in the housing 31, as shown in FIG. 5. The flow path 26 with selector valve is provided with a shuttle type selector valve 101, check valves 102 and 103, a retraction side relief valve 104, an extension side relief valve 105, a retraction side damping valve 106A and a manual selector valve 107.

The shuttle type selector valve 101 has a shuttle piston 111, and a first check valve 112A and a second check valve 112B which are positioned on both sides of the shuttle piston 111. This defines a first shuttle chamber 113A on a side of the first check valve 112A of the shuttle piston 111, and defines a second shuttle chamber 113B on a side of the second check valve 112B of the shuttle piston 111. The first check valve 112A can be actuated to be opened by an oil feeding pressure which is applied to the first shuttle chamber 113A via a duct line 93A by a forward rotation of the pump 24. The second check valve 112B can be actuated to be opened by an oil feeding pressure which is applied to the second shuttle chamber 113B via the duct line 93B by a reverse rotation of the pump 24. Further, the shuttle piston 111 can actuate to open the second check valve 112B by the oil feeding pressure caused by the forward rotation of the pump 24, and can actuate to open the first check valve 112A by the oil feeding pressure caused by the reverse rotation of the pump 24.

The first check valve 112A of the shuttle type selector valve 101 is connected to the first flow path 91, and the second check valve 112B is connected to the second flow path 92.

The check valve 102 is interposed in a connection duct line 94A between the pump 24 and the tank 25. In other words, since an internal volume of the first tilt chamber 42A is increased only by a retraction volume of the piston rod 61 and a circulating oil amount of the working fluid comes short at a time of the tilt-up operation of the marine vessel propulsion machine 10, the check valve 102 is actuated to open, and can compensate a shortfall of the circulating oil amount from the tank 25 to the pump 24.

The check valve 103 is interposed in a connection duct line 94B between the pump 24 and the tank 25. In other words, the trim piston 51 reaches a maximum retraction position and the trim down is completed at a time of the trim-down operation of the marine vessel propulsion machine 10, and in the case where the pump 24 still actuates at a time point when the return oil from the second trim chamber 32B to the pump 24 runs short, the check valve 103 is actuated to open, and can supply the working fluid from the tank 25 to the pump 24.

The retraction side relief valve 104 is connected to the first shuttle chamber 113A, and relieves a circuit pressure to the tank 25 at a set pressure, for bringing back an oil amount at a surplus rod at a time of the tilt-down actuation and the trim-down actuation to the tank 25, and for protecting the hydraulic circuit at a time of keeping actuating the pump 24 even after the trim-down is completed.

The extension side relief valve 105 is embedded in the shuttle piston 111, and relieves the circuit pressure to the tank 25 at a set pressure, for protecting the hydraulic circuit at a time of keeping actuating the pump 24 even after the piston rod 61 reaches a maximum extension position and the tilt-up is completed at a time of the tilt-up operation.

The retraction side damping valve 106A relieves the circuit pressure to the tank 25 at a set pressure for protecting the hydraulic circuit when any impact force in a direction of retracting the piston rod 61 is applied to the propulsion unit 15 (when, for example, an obstacle comes into collision with the propulsion unit 15 from behind), during a logging in a state in which the tilt piston 71 of the cylinder apparatus 21 is at an intermediate position of the tilt chamber 42.

The manual selector valve 107 is interposed in the communication passage 95 between the first flow path 91 and the second flow path 92, and extends and retracts the cylinder apparatus 21 manually by conducting the first flow path 91 and the second flow path 92, thereby making the propulsion unit 15 tiltable in the trim region and the tilt region.

A description will be given below of an actuation of the trim/tilt apparatus 20.

(1) Trim-Up

If the motor 23 and the pump 24 are rotated reversely, the discharge oil of the pump 24 flows into the second shuttle chamber 113B of the shuttle type selector valve 101 from the duct line 93B, and the shuttle piston 111 moves to a right side in FIG. 5, and pushes open the first check valve 112A. Further, the working fluid flowing into the second shuttle chamber 113B of the selector valve 101 pushes open the second check valve 112B by its own pressure, and is fed to the second trim chamber 32B via the duct line 92, as shown by a solid arrow. In accordance with this, the working fluid flowing into the second trim chamber 32B is going to push up the trim piston 51. In this case, the working fluid in the second trim chamber 32B not only acts on the trim piston 51, but also acts on the tilt piston 71 which comes into close contact with the trim piston 51 through the through hole shaped communication passage 53 of the trim piston 51. However, since an area of the communication passage 53 is set such that a pressure receiving area of the trim piston 51 is larger than a pressure receiving area of the tilt piston 71, the trim piston 51 moves so as to push up the tilt piston 71. At this time, since the working fluid in the first trim chamber 32A flows out to the first flow path 91, and further comes back to the pump 24, the trim piston 51 moves and makes the cylinder 41 and the piston rod 61 protrude outward of the housing 31, thereby trimming up. Further, the trim piston 51 comes into collision with a stroke end in a trim-up direction within the first trim chamber 32A, thereby trimming up to the maximum.

(2) Tilt Up

In the item (1) mentioned above, if the working fluid is further supplied to the second trim chamber 32B after the trim piston 51 moves to the maximum trim-up, a pressure of a working fluid inside the second trim chamber 32B is applied to an end surface in an opposite side to the piston rod 61 of the tilt piston 71 from the through hole shaped communication passage 53 which is provided in the trim piston 51. In accordance with this, since the working fluid supplied to the second trim chamber 32B is filled in the second tilt chamber 42B which is formed between the trim piston 51 and the tilt piston 71 inside the cylinder 41 so as to be expanded gradually. The working fluid inside the first tilt chamber 42A flows out to the first flow path 91 via the passage 91A which is provided in the rod guide 43 of the cylinder 41, the communication passage 46 of the cylinder 41, the passage 91B which is provided in the outer pipe 41B of the cylinder 41, the passage 91C which is provided in the cylinder guide 34 of the housing 31, and the first trim chamber 32A, only the tilt piston 71 moves. In accordance with this, the piston rod 61 protrudes to the outer side of the cylinder 41 and tilts up. Further, the tilt piston 71 comes into collision with the stroke end in the tilt-up direction within the first tilt chamber 42A, and tilts up to the maximum.

(3) Tilt-Down

If the motor 23 and the pump 24 rotate forward, the discharge oil from the pump 24 flows into the first shuttle chamber 113A of the selector valve 101 from the duct line 93A, and the shuttle piston 111 moves to a left side in FIG. 5 and pushes open the second check valve 112B. Further, the working fluid flowing into the first shuttle chamber 113A of the selector valve 101 pushes open the first check valve 112A by its own pressure, and is fed to the first tilt chamber 42A from the first flow path 91 via the first trim chamber 32A, the passage 91C, the passage 91B, the communication passage 46 of the cylinder 41, and the passage 91A, as shown by a broken arrow. If the working fluid flows into the first tilt chamber 42A in this manner, the working fluid pushes down the tilt piston 71. In this case, the working fluid in the first trim chamber 32A acts on the trim piston 51 at this time. However, since the pressure receiving area of the tilt piston 71 facing the first tilt chamber 42A is set to be larger than the pressure receiving area of the trim piston 51 facing the first trim chamber 32A, only the tilt piston 71 is pushed down until the tilt piston 71 comes into collision with the trim piston 51. In accordance with this, the piston rod 61 is absorbed into an inner side of the cylinder 41 and tilts down. At this time, the working fluid in the second tilt chamber 42B flows out to the second flow path 92 from the through hole shaped communication passage 53 of the trim piston 51 via the second trim chamber 32B, and further comes back to the pump 24. Further, the tilt piston 71 comes into collision with the trim piston 51 which stays at the stroke end in the trim-up direction of the trim chamber 32, and finishes tilting down.

(4) Trim Down

If the working fluid is further supplied to the first trim chamber 32A and the first tilt chamber 42A after the tilt-down in the item (3) mentioned above is finished, the tilt piston 71 is combined with the trim piston 51 so as to be pushed down to the side of the second trim chamber 32B, and the working fluid inside the second trim chamber 32B flows out to the second flow path 92. The cylinder 41 and the piston rod 61 are absorbed further to the inner side of the housing 31, and trims down. Further, the trim piston 51 comes into collision with the stroke end in the trim-down direction within the second trim chamber 32B, and finishes trimming down.

In this case, in the trim/tilt apparatus 22, an effective area of the pistons 51 and 71 changes between the large-diameter trim piston 51 and the small-diameter tilt piston 71, in a transition process from the trim-up to the tilt-up in the items (1) to (2) mentioned above, and a transition process from the tilt-down to the trim-down in the items (3) to (4). Accordingly, a transition speed of the piston rod 61 is faster in the tilt region than in the trim region, and a force acting on the piston rod 61 is larger in the trim region than in the tilt region. In other words, in the embodiment mentioned above, (a) in the trim region, it is possible to carry out a fine adjustment of a trim angle against a propeller thrust, and it is possible to carry out a shallow water navigation, and (b) in the tilt region, it is possible to rapidly tilt up and down with a comparatively small force which is necessary for supporting its own weight of the propulsion unit.

Accordingly, in the trim/tilt apparatus 20, in order to achieve a weight saving and a cost reduction by a reduction of the number of parts, as well as coping with the collision of the driftwood, the following structures are provided.

First of all, the trim piston 51 is provided with the communication passage 53 mentioned above and communicating the second tilt chamber 42B with the second trim chamber 32B, thereby enabling the second tilt chamber 42B between the trim piston 51 and the tilt piston 71 to be normally directly communicated with the second trim chamber 32B. In other words, such a structure as the conventional free piston is not provided inside the second tilt chamber 42B.

Next, the tilt piston 71 is provided with a shock blow valve 73. This is opened when the impact force in the extending direction of the cylinder apparatus 21 is applied at a time of the collision of the driftwood against the propulsion unit 15 and the working fluid in the first tilt chamber 42A reaches the set pressure, and transfers the working fluid in the first tilt chamber 42A to the second tilt chamber 42B. The tilt piston 71 is not provided with such a structure as the conventional return valve which brings back the working fluid in the second tilt chamber 42B to the first tilt chamber 42A.

Therefore, in accordance with the present embodiment, the following operations and effects can be achieved.

(a) If the driftwood comes into collision with the propulsion unit 15 under logging in the arbitrary trim attitude (the trim/tilt apparatus 20 is in the state shown in FIG. 3), and the impact force in the extending direction of the cylinder apparatus 21 is applied to the propulsion unit 15, the shock blow valve 73 opens at the set pressure, the working fluid in the first tilt chamber 42A is transferred to the second tilt chamber 42B having no free piston, that is, the second tilt chamber 42B between the trim piston 51 and the tilt piston 71, the piston rod 61 is extended, and the propulsion unit 15 is flipped up from the original trim attitude (the trim/tilt apparatus 20 comes to a state shown in FIG. 4), and absorbs the impact force.

At this time, since the piston rod 61 is extended abruptly by the impact, a volume increasing amount of the second tilt chamber 42B is much larger with respect to the oil amount which is transferred to the second tilt chamber 42B, and a vacuum portion is generated in the second tilt chamber 42B.

Figure 3:
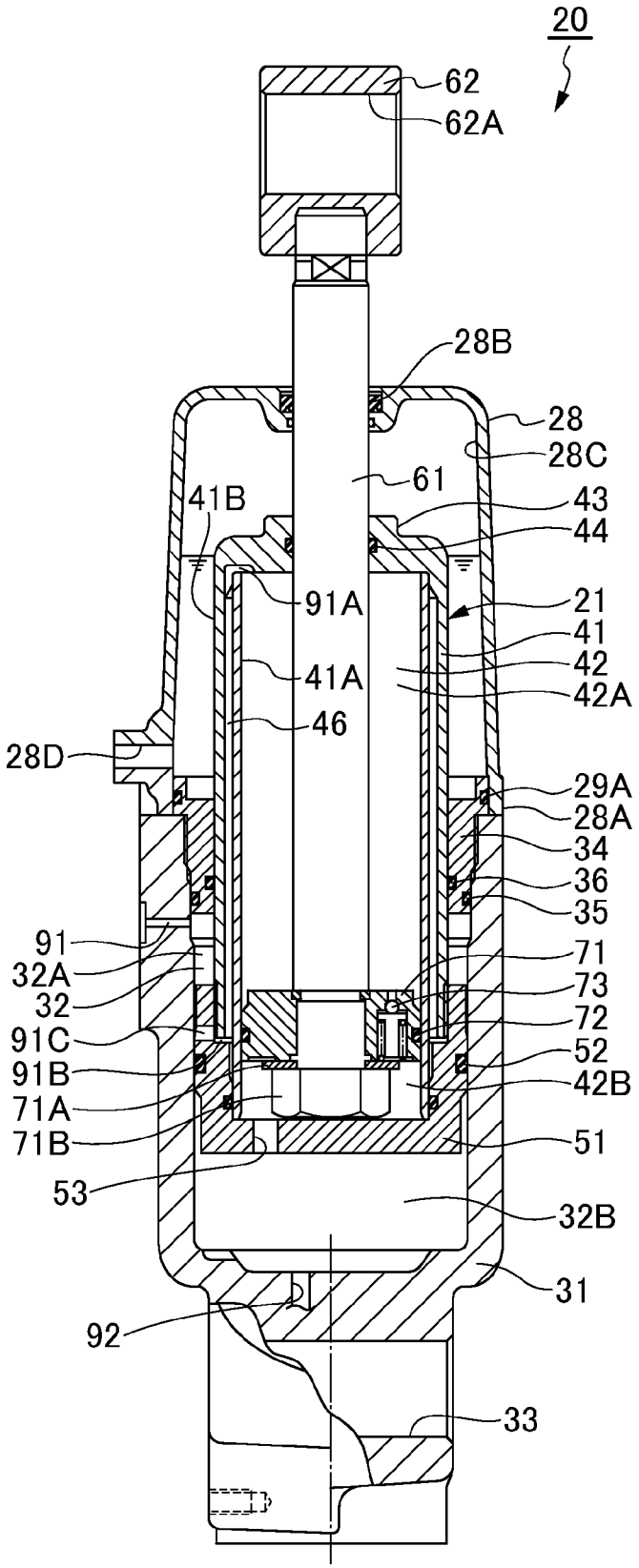
FIG. 3 is a schematic view showing a trim-up state.
Figure 4:
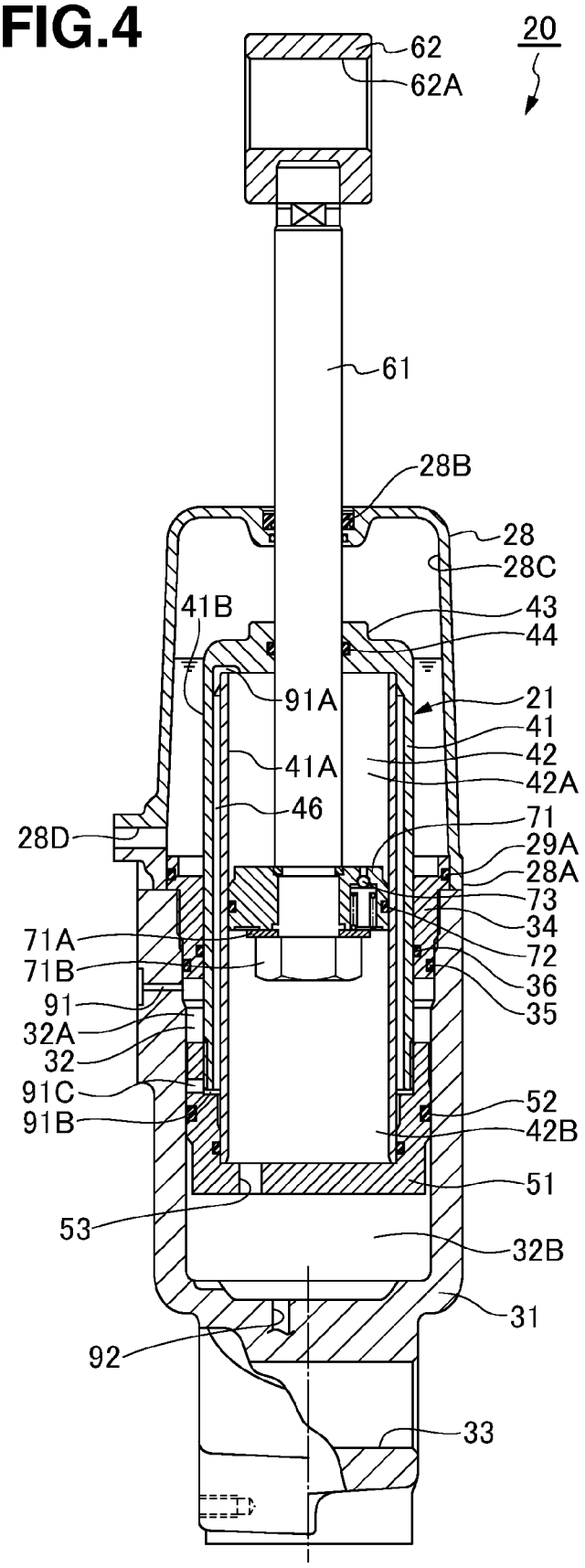
FIG. 4 is a schematic view showing a collision state of a driftwood.

Accordingly, the tilt piston 71 of the piston rod 61 goes into the second tilt chamber 42B such that its own weight of the propulsion unit 15 crushes the vacuum portion of the second tilt chamber 42B mentioned above, after absorbing the impact force by the valve opening mentioned above of the shock blow valve 73, thereby coming back to the trim attitude which can log and in which the propeller of the propulsion unit 15 is immersed (the trim/tilt apparatus 20 comes back to the state shown in FIG. 3).

(b) In accordance with the item (a) mentioned above, in the trim/tilt apparatus 20 which can cope with the collision of the driftwood, the free piston is not provided, and the return valve is not provided in the tilt piston 71. It is possible to achieve a weight saving and a cost reduction by reducing the number of parts.

As heretofore explained, embodiments of the present invention have been described in detail with reference to the drawings. However, the specific configurations of the present invention are not limited to the illustrated embodiments but those having a modification of the design within the range of the presently claimed invention are also included in the present invention.

In accordance with the present invention, there is provided a trim/tilt apparatus for a marine vessel propulsion machine, comprising: a cylinder apparatus interposed between a hull and a marine vessel propulsion machine which is supported to the hull so as to be tiltable, the cylinder apparatus being extended and retracted so as to make the marine vessel propulsion machine carry out a trim motion and a tilt motion, by controlling to supply or discharge a working fluid from a working fluid supply/discharge apparatus to the cylinder apparatus. The cylinder apparatus comprises a housing which is used by being connected to one of the hull and the marine vessel propulsion machine and forms a large-diameter trim chamber. A cylinder is inserted into the trim chamber of the housing so as to be extensible and retractable, and forms a small-diameter tilt chamber. A large-diameter trim piston is fixed to a cylinder end portion inside the trim chamber of the housing, and divides the trim chamber into a first trim chamber on a side which accommodates the cylinder, and a second trim chamber on a side which does not accommodate the cylinder. A piston rod is used by being connected to the other of the hull and the marine vessel propulsion machine, and is inserted into the tilt chamber of the cylinder so as to be extensible and retractable. A small-diameter tilt piston is fixed to a piston rod end portion inside the tilt chamber of the cylinder and divides the tilt chamber into a first tilt chamber on a side which accommodates the piston rod and a second tilt chamber on a side which does not accommodate the piston rod. The trim piston is provided with a communication passage which communicates the second tilt chamber with the second trim chamber, thereby enabling the second tilt chamber between the trim piston and the tilt piston to be normally directly communicated with the second trim chamber. The tilt piston is provided with a shock blow valve which is opened so as to transfer the working fluid in the first tilt chamber to the second tilt chamber, when the working fluid in the first tilt chamber reaches a set pressure. Accordingly, in a trim/tilt apparatus which can cope with collision of a driftwood, it is possible to achieve a weight saving and a cost reduction by a reduction of the number of parts, in a trim/tilt apparatus which can cope with collision of a driftwood.

Although the invention has been illustrated and described with respect to several exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiment set out above, but should be understood to include all possible embodiments which can be encompassed within a scope of equivalents thereof with respect to the features set out in the appended claims.

What is claimed is:

1. The trim/tilt apparatus for a marine vessel propulsion machine, comprising:

a cylinder apparatus interposed between a hull and a marine vessel propulsion machine which is supported to the hull so as to be tiltable, the cylinder apparatus being extended and retracted so as to make the marine vessel propulsion machine carry out a trim motion and a tilt motion, by controlling to supply or discharge a working fluid from a working fluid supply/discharge apparatus to the cylinder apparatus, the cylinder apparatus comprising:

a housing which is used by being connected to one of the hull and the marine vessel propulsion machine and forms a large-diameter trim chamber;

a cylinder which is inserted into a trim chamber of a housing so as to be extensible and retractable, and forms a small-diameter tilt chamber;

wherein the cylinder is inserted into the trim chamber from a cylinder guide which is provided in an open end of the housing so the cylinder is extensible and retractable, at a time of a trim up and down operation in a trim region, and the cylinder guide is threadably attached to the open end of the housing, and is provided with a seal member which comes into close contact with the trim chamber, and a seal member which comes into slidable contact with an outer surface of the cylinder, a large-diameter trim piston which is fixed to the cylinder inside the trim chamber of the housing, and divides the trim chamber into a first trim chamber on a side which accommodates the cylinder, and a second trim chamber on a side which does not accommodate the cylinder;

a piston rod which is used by being connected to either other of the hull and the marine vessel propulsion machine, and is inserted into the tilt chamber of the cylinder so as to be extensible and retractable; and a small-diameter tilt piston which is fixed to a piston rod end portion inside the tilt chamber of the cylinder, and divides the tilt chamber into a first tilt chamber on a side which accommodates the piston rod and a second tilt chamber on a side which does not accommodate the piston rod, wherein the large diameter trim piston is provided with a communication passage which communicates the second tilt chamber with the second trim chamber, thereby enabling the second tilt chamber between the large diameter trim piston and the small diameter tilt piston to be normally directly communicated with the second trim chamber, and the small diameter tilt piston is provided with a shock blow valve which is opened so as to transfer the working fluid in the first tilt chamber to the second tilt chamber, when the working fluid in the first tilt chamber reaches a set pressure.

2. The trim/tilt apparatus for a marine vessel propulsion machine comprising:

a cylinder apparatus interposed between a hull and a marine vessel propulsion machine which is supported to the hull so as to be tiltable, the cylinder apparatus being extended and retracted so as to make the marine vessel propulsion machine carry out a trim motion and a tilt motion, by controlling to supply or discharge a working fluid from a working fluid supply/discharge apparatus to the cylinder apparatus, the cylinder apparatus comprising:

a housing which is used by being connected to one of the hull and the marine vessel propulsion machine and forms a large-diameter trim chamber;

a cylinder which is inserted into a trim chamber of a housing so as to be extensible and retractable, and forms a small-diameter tilt chamber;

wherein the cylinder is inserted into the trim chamber from a cylinder guide which is provided in an open end of the housing so as to be extensible and retractable, at a time of a trim up and down operation in a trim region, and the cylinder guide is threadably attached to the open end of the housing, and is provided with a seal member which comes into close contact with the trim chamber, and a seal member which comes into slidable contact with an outer surface of the cylinder, wherein the cylinder is structured such that a portion protruding outward from the cylinder guide of the housing in a trim motion region is covered with a sub tank housing which constitutes the working fluid supply/discharge apparatus, a lower end opening portion of the sub tank housing is fitted around the cylinder guide, and a lower end flange portion of the sub tank housing is fastened in a liquid tight manner to the open end surface of the housing via a seal member, and a seal member enabling the piston rod to come into slidable contact in a liquid tight manner is provided in an upper end opening portion of the sub tank housing, a large-diameter trim piston which is fixed to the cylinder inside the trim chamber of the housing, and divides the trim chamber into a first trim chamber on a side which accommodates the cylinder, and a second trim chamber on a side which does not accommodate the cylinder;

a piston rod which is used by being connected to either other of the hull and the marine vessel propulsion machine, and is inserted into the tilt chamber of the cylinder so as to be extensible and retractable; and a small-diameter tilt piston which is fixed to a piston rod end portion inside the tilt chamber of the cylinder, and divides the tilt chamber into a first tilt chamber on a side which accommodates the piston rod and a second tilt chamber on a side which does not accommodate the piston rod, wherein the large diameter trim piston is provided with a communication passage which communicates the second tilt chamber with the second trim chamber, thereby enabling the second tilt chamber between the large diameter trim piston and the small diameter tilt piston to be normally directly communicated with the second trim chamber, and the small diameter tilt piston is provided with a shock blow valve which is opened so as to transfer the working fluid in the first tilt chamber to the second tilt chamber, when the working fluid in the first tilt chamber reaches a set pressure.

* * * * *